United States Patent [19]

Perkins

[11] 4,063,475

[45] Dec. 20, 1977

[54] LUG NUT TOOL

[76] Inventor: Robert L. Perkins, 858 N. 96th St., Mesa, Ariz. 85207

[21] Appl. No.: 641,612

[22] Filed: Dec. 17, 1975

[51] Int. Cl.[2] ..... B25B 17/00

[52] U.S. Cl. ..... 81/57.22; 81/57.3

[58] Field of Search ..... 81/57.3, 180 R, 58.1, 81/54, 57.22

[56] References Cited

U.S. PATENT DOCUMENTS

| | | | |
|---|---|---|---|
| 1,346,505 | 7/1920 | Mitchell | 81/57.3 |
| 1,423,142 | 7/1922 | Owens | 81/57.3 |
| 2,482,387 | 9/1949 | Veneman | 81/57.3 |
| 2,614,444 | 10/1952 | Moore | 81/180 |
| 3,905,254 | 9/1975 | Palatnick et al. | 81/57.3 |

*Primary Examiner*—James L. Jones, Jr.
*Attorney, Agent, or Firm*—Gregory J. Nelson

[57] ABSTRACT

A lug nut tool for removing lug nuts from vehicle wheels. The tool includes a casing or body which carries a drive shaft which drives a shaft carrying a socket through a gear transmission. The gear transmission has an uneven number of gears and serves to increase or multiply the torque applied at the drive shaft. Another spindle shaft is also rotatably mounted in the casing and carries a socket for engaging an adjacent lug nut to secure and stabilize the tool during use. The device can be driven by a manual wrench or other drive such as a power tool or impact tool.

2 Claims, 5 Drawing Figures

LUG NUT TOOL

The present invention relates to a tool and more particularly relates to a wrench for loosening and removing lug nuts from vehicle wheels.

Conventional vehicle wheels for mounting pneumatic tires are normally retained in place on an axle mounted drum by means of studs and removable lug nuts. Vehicle maintenance or repair or replacement of a tire requires that the wheel be removed. Often lug nuts are extremely difficult to loosen being "frozen" in place either due to rust or other debris in the threads or because of excessive torque applied to lug nuts when the nuts were initially tightened. Removal of frozen lug nuts is a particular problem to the motorist or commercial driver experiencing a flat tire at a remote location where no service is available. The driver must loosen the lug nuts to change the tire usually having only a manual lug wrench available. Often a manual wrench cannot be manipulated to apply sufficient torque to break the nuts free. Another difficulty often encountered is that the user in trying to apply sufficient leverage causes the wrench to slip from the nut often damaging the faces of the nut making it even more difficult to remove the nut.

A number of tools and wrenches which provide greater mechanical advantage than a simple wrench have been proposed in the prior art. Most of these wrenches have not found wide acceptance in that they are either extremely complex and therefore prohibitive in cost or are ineffective for their intended purpose.

A practical solution to the problem is shown in U.S. Pat. No. 3,905,254 issued to Palatnick which shows a tool for loosening and removing lug nuts which has a rotatable socket which is manually turned through a gear arrangement operated through a crank. A non-rotative stabilizing socket is positioned to engage other nuts of the wheel while one nut is being loosened. While the tool of this patent represents a substantial advance in the state of the art, it nevertheless presents certain difficulties to the user. For example, the gear arrangement results in the driven socket for removing the nut being rotated in the direction opposite to the rotation of the crank handle. The tool of the Palatnick patent does not permit the user to remove any previously loosened nuts as only the driven socket can be rotated.

Accordingly, the present invention represents an improvement over the wrench of the type shown in the prior patent discussed above. Briefly, the present invention provides a torque multiplying wrench which may be either manipulated manually or by a power drive. The wrench includes a casing with a driven shaft and a spindle or stabilizing shaft which are in spaced relationship so that they correspond in position to two of the nuts on the bolt circle of a wheel upon which they are to be used. Both shafts are journalled for rotation and the inner end of the shafts can detachably secure a lug receiving socket. The outer end of the spindle shaft extends through the opposite side of the housing and carries a drive end cooperable with a suitable manual or power drive. A drive shaft is also rotatively secured in the housing. The drive shaft carries a pinion which meshes with the intermediate gear which, in turn, meshes with a gear carried on the driven shaft. The gears serve as transmission which multiplies torque applied at the drive shaft and delivered at the driven shaft. Further, the driven shaft and drive shaft are both rotated in the same direction of operation.

In order to secure and stabilize the position of the wrench during use, the sockets carried on the spindle and driven shafts are both engageable on adjacent nuts on the wheel. This prevents the tool from slipping off during use and serves to oppose the torque applied at the drive shaft so that the entire tool does not twist.

The above and other objects and advantages of the present invention will become more apparent from the following description, claims and drawings, in which:

Figure 1:
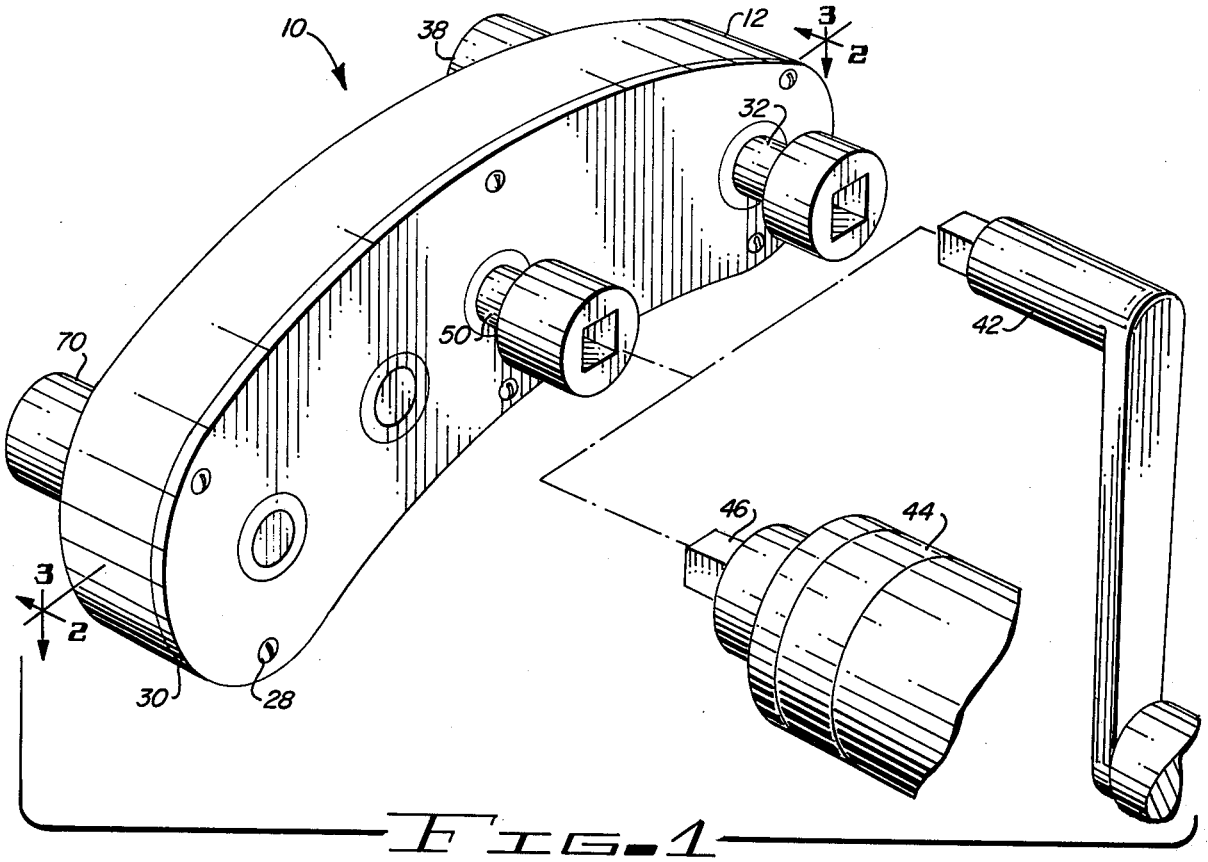
FIG. 1 is a perspective view of the tool of the present invention showing alternate forms of drives which may be used with the tool.
Figure 2:
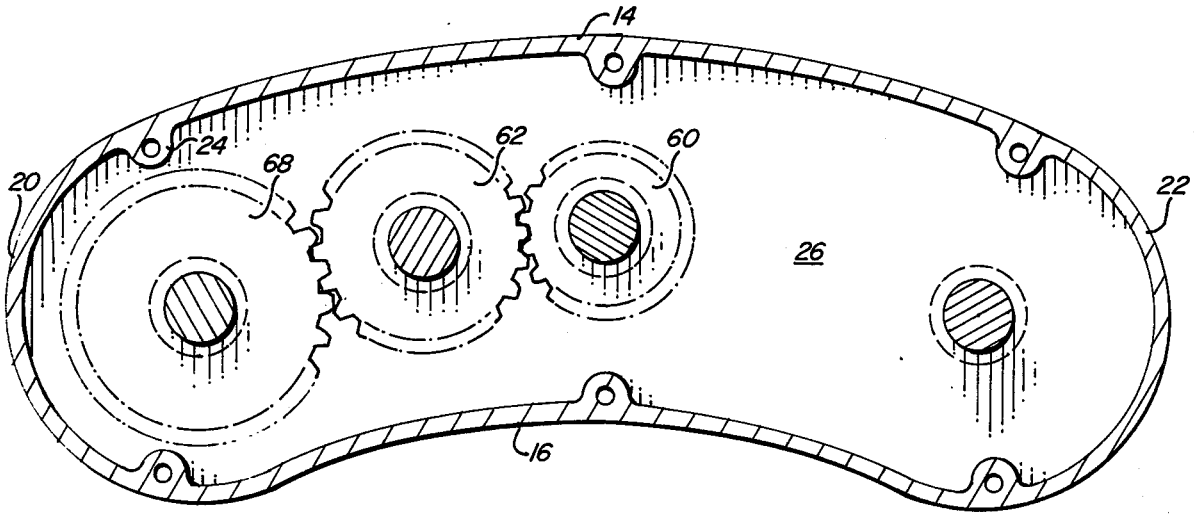
FIG. 2 is a sectional view taken along lines 2—2 of FIG. 1 illustrating the gear transmission located within the casing.
Figure 3:
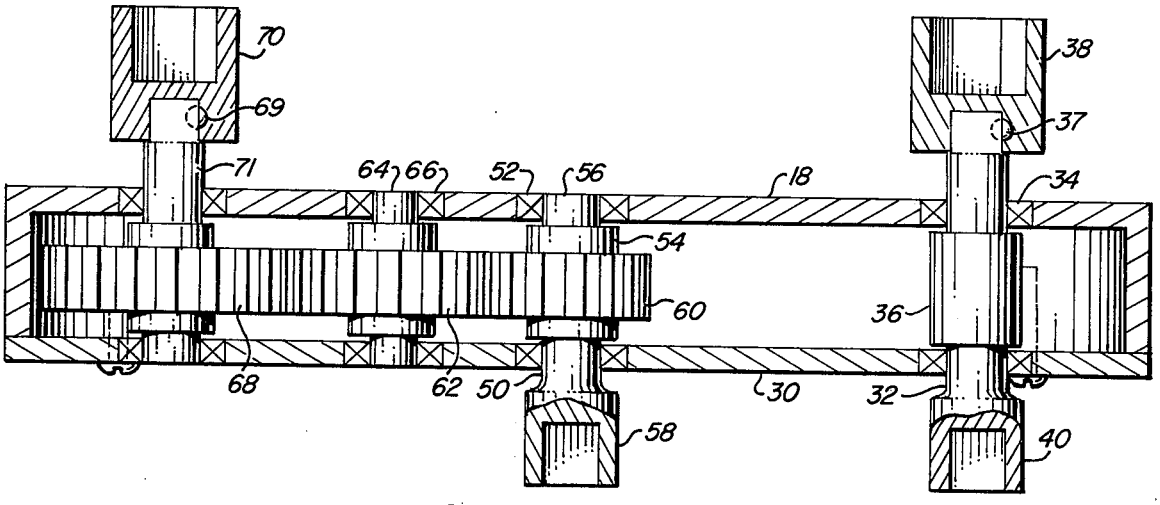
FIG. 3 is a sectional view of the tool of the present invention taken along lines 3—3 of FIG. 2.
Figure 5:
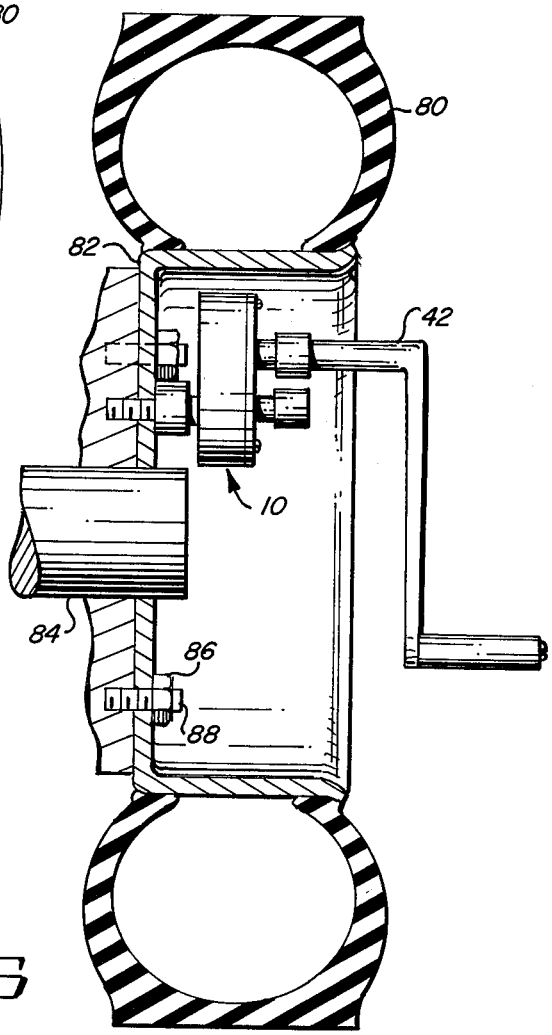
FIG. 5 is a sectional view taken along lines 5—5 of FIG. 4 further illustrating the tool of the present invention in a position of use.

Referring now to the drawings, particularly FIGS. 1 through 3, the tool of the present invention is generally designated by the numeral 10. Tool 10 includes a body or casing 12 having a curved top and bottom walls 14 and 16, rear wall 18 and opposite rounded ends 20 and 22. Preferably the casing is integrally cast from a suitable material such as a high quality tool steel. In order to make the tool as compact and convenient as possible, the configuration of the housing 12 is preferably curved or arcuate corresponding to the arc of the bolt circle of the wheel upon which the tool is to be used. As seen in FIG. 5, the overall vertical width of the tool 10 should be maintained as small as possible to prevent interference with the vehicle wheel. Bosses 24 are provided at locations along the housing and gear 26 and are tapped and receive bolts 28 which secure face plate 30 in place enclosing gear chamber 26.

A spindle shaft 32 is rotatively mounted in bearings 34 secured in housing wall 18. Spindle 32 has enlarged cylindrical section 36 axially extending across the interior of the wrench. One end of spindle shaft 32 carries a drive projection 37, preferably with detent means not shown, which can be engaged within the aperture provided in conventional socket 38. Socket 38 can be removed from spindle shaft 32 simply by applying an axial separation pressure. In this way sockets in various sizes can be removably attached to the spindle 32. The other end of spindle 32 carries a female socket member 40 which is engageable with a suitable drive tool. As is seen in FIG. 1, the drive tool may comprise a manually operable crank or lever 42 or may be a power tool 44. Power tool 44 shown as an air impact wrench having a male end 46 engageable with socket 40 of spindle 32.

Drive shaft 50 is rotatively mounted in housing 12 at a central location in housing 12. Drive shaft 50 has a stub shaft portion 56 which is rotatively received in bearings 52 pressed in the back wall 18 of the housing. An enlarged cylindrical section 54 of the shaft axially extend within enclosure 26. Drive shaft 50 projects through the front plate 30 terminating at socket drive end 58. End 58 can be engaged in the socket or chuck of a crank or power drive tool. A pinion gear 60 is keyed to shaft 50 at intermediate section 54.

Pinion gear 60 intermeshes with idler gear 62 which is rotatively mounted in bearings 66 on idler shaft 64 and rotative within bearings 66. Idler gear 62, in turn, meshes with driven gear 68. Gear 68 is keyed to shaft 65 which extends through the rear plate 18 of the housing terminating at drive end 69 which is adapted to be received within the aperture of a conventional socket 70 so that the socket can be detached and replaced as required. Detent means, such as a spring-loaded ball, may be carried on end 69 to retain socket 70 thereon. Drive shaft 65 is mounted for rotation in bearings 71 pressed into wall 18 of housing 12.

The three gears 60, 62 and 68 together comprise a torque multiplying transmission. It will be obvious that since pinion gear 60 is smaller than idler gear 62 which is, in turn, smaller than driven gear 68 that torque delivered at shaft 64 is a multiple of the torque applied at shaft 50. Further, since an odd number of gears comprise a gear transmission, drive shaft 50 and shaft 64 carrying socket 70 rotate in the same direction.

Figure 4:
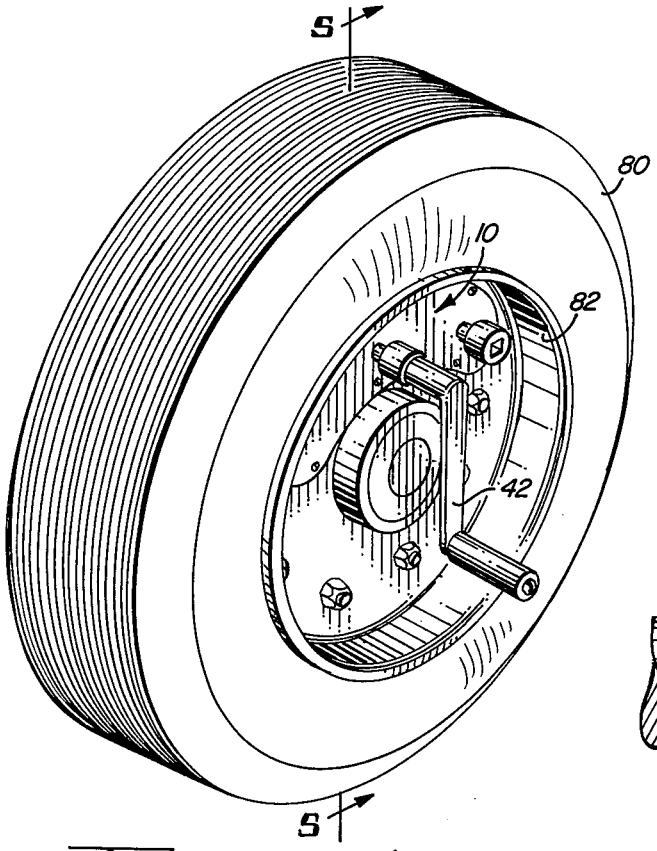
FIG. 4 is a perspective view showing the tool of the present invention in a position of use on a conventional wheel and tire assembly.

The advantages of the invention will be more readily appreciated from the following description of use. Referring to the drawings and particularly to FIGS. 4 and 5, a conventional pneumatic vehicle tire 80 is shown in an inflated condition on wheel 82. Wheel 82 is secured to drum 83 for rotation with vehicle axle 84 by a plurality of lug nuts 86 threadedly engaged on studs 88. The studs 88 are equally spaced about a bolt circle and passenger vehicles and smaller capacity trucks normally have five or six bolts at equally spaced positions. Heavy duty vehicles and trucks often have a greater number, ten being typical for a commercial diesel truck or trailer. The lug nuts are generally hexagonal and are threaded so that they do not become disengaged or loosened during normal rotation of the wheel in forward motion of the vehicle.

To remove the tire and wheel, wrench 10 is engaged on lug nuts 86. This is accomplished by engaging socket 70 over one lug nut and socket 38 over an adjacent lug nut. The relative position and spacing of spindle shaft 32 and driven shaft 65 is designed so the sockets 70 and 38 are directly aligned with the lug nuts. An appropriate drive is engaged with socket end 58 of drive shaft 50. The drive may be a crank or lever such as crank 42 shown in FIG. 1. In the case of commercial vehicles, often an auxiliary pneumatic supply is available and a power tool such as an air driven impact wrench 44 may be used with the male end 46 of the wrench engaging socket 58 of shaft 50. Shaft 50 is rotated in a direction to loosen the lug nut engaged within socket 70. The torque applied to shaft 50 is increased across the gear train comprised of gears 60, 62 and 68. The increased torque should be sufficient to break even the tightest nut. Shaft 50 is turned only until the nut engaged at socket 70 is loosened. It is preferred that this nut is not completely removed at this time.

The socket 38 on spindle shaft 32 serves to stabilize the deivice and oppose the torque applied at shaft 50 to prevent the entire tool from rotating.

Once the nut engaged at socket 70 is loosened, the tool is removed and advanced one lug as seen in FIG. 4 with socket 70 engaging the nut next adjacent the one previously loosened. Socket 38 is now secured about the nut previously loosened. Drive shaft 50 is rotated by an appropriate tool causing the nut now engaged at socket 70 to be loosened. After this is accomplished spindle shaft 32 can be rotated to completely disengage the nut thereon from its associated stud 88. It is preferred that this procedure be followed since socket 38 trails in the loosening procedure and is always engaged about a loosened lug nut. After the second lug nut in a sequence has been loosened at socket 70, spindle 32 can be turned by removing the drive and engaging it on the spindle to completely disengage the lug nut within socket 38. The entire tool 10 can then be removed bringing the loosened lug nut within socket 38 along with it. Lug nut within socket 38 is removed from the socket and placed in a proper location. This procedure is repeated until all the lug nuts have been loosened and sequentially removed at the socket 38.

The tool of the present invention can be used with various sized lug nuts. For example, sockets 38 and 70 can be removed and replaced with sockets of a different size if required. For example, it is common for tandem dual tire arrangements to have different size lug nuts on the inner and outer wheel. Thus, the driver can easily adapt the tool to remove either wheel by engaging the appropriate size socket on the tool.

The tool of the present invention is basically intended to be employed for only one arrangement of lug nuts. It would be necessary to have a different tool for each model or make of vehicle which has a different arrangement of lug nuts. This is no particular disadvantage as the tool would be designed to fit a particular model and generally would be carried with the vehicle.

Thus the tool of the present invention is efficient and provides the user with great mechanical advantage to remove lug nuts which would otherwise be very difficult or impossible to remove. The tools can be manually or power driven and the sockets engaging the nut to be removed rotate in the same direction as the drive shaft. The tool is small and compact to be easily and conveniently secured in a position of use.

It will be obvious to those skilled in the art to make various changes, alterations and modifications to the embodiments herein described. To the extent that these changes, alterations and modifications do not depart from the spirit and scope of the appended claims, they are intended to be encompassed therein.

I claim:

1. A lug wrench for loosening or tightening lug nuts which secure a vehicle wheel in place, said wrench comprising:

a. a casing having a curved configuration generally conforming to the wheel upon which it is to be used;

b. a drive shaft rotatably mounted in said casing having an end adapted to cooperate with drive means;

c. a driven shaft having an end adapted to detachably secure sockets thereon for engaging a first lug nut on the wheel;

d. a gear transmission interconnecting said drive and driven shafts, said transmission driving said driven shaft in the same rotational direction as the driving shaft, said transmission having intermeshing gears relatively sized to develop increased torque across said transmission; and e. a spindle shaft rotatively mounted in said housing and having one end adapted to detachably receive a socket and said spindle shaft being spaced from said driven shaft and positioned for a socket received thereon to engage a second lug nut on the wheel, the opposite end of said spindle shaft being adapted to be rotated by a driving tool, said spindle being rotative independent of said drive shaft whereby said lug wrench can be engaged with two lug nuts on the same wheel a loose nut can be removed at said spindle shaft.

2. The lug wrench of claim 1 wherein said gear transmission includes a pinion on said drive shaft, an idler gear and a driven gear on said driven shaft.

* * * * *